US010787016B1

(12) United States Patent
Thompson

(10) Patent No.: US 10,787,016 B1
(45) Date of Patent: Sep. 29, 2020

(54) SHEET MATERIAL FOLDABLE TO FORM THREE-DIMENSIONAL SIGNAGE

(71) Applicant: Laminators Incorporated, Hatfield, PA (US)

(72) Inventor: Scott Thompson, Hatfield, PA (US)

(73) Assignee: LAMINATORS INCORPORATED, Hatfield, PA (US)

( * ) Notice: Subject to any disclaimer, the term of this patent is extended or adjusted under 35 U.S.C. 154(b) by 0 days.

(21) Appl. No.: 16/538,277

(22) Filed: Aug. 12, 2019

(51) Int. Cl.
*B42D 15/00* (2006.01)
*B31B 50/26* (2017.01)
*B31B 100/00* (2017.01)

(52) U.S. Cl.
CPC ..... *B42D 15/008* (2013.01); *B31B 50/26* (2017.08); *B31B 2100/0022* (2017.08); *B31B 2100/0024* (2017.08)

(58) Field of Classification Search
CPC ..... B42D 15/008; G09F 1/06; G09F 7/00
See application file for complete search history.

(56) References Cited

U.S. PATENT DOCUMENTS 2,023,419 A * 12/1935 Hailparn ..... G09F 1/06 40/539
2,035,651 A * 3/1936 Hailparn ..... G09F 1/06 40/539
3,176,419 A * 4/1965 Stein ..... G09F 1/14 40/610
3,292,796 A * 12/1966 Paige ..... A47F 5/114 211/132.1
3,322,382 A * 5/1967 Rohrbach ..... A47F 11/02 248/159
3,755,942 A * 9/1973 Samsing ..... B65D 73/0021 40/607.11
5,921,011 A * 7/1999 Hawver ..... G09F 7/18 248/174
2013/0061499 A1* 3/2013 Berglund ..... G09F 1/00 40/607.1
2013/0232836 A1* 9/2013 Holt ..... G09F 15/00 40/610
2015/0275446 A1* 10/2015 Rust ..... E01F 13/022 256/26
2016/0098946 A1* 4/2016 LeMay ..... G09F 15/0037 40/584

* cited by examiner

*Primary Examiner* — Gary C Hoge
(74) *Attorney, Agent, or Firm* — Buchanan Ingersoll & Rooney PC

(57) ABSTRACT

A system in which flat sheet stock can be digitally printed then formed and folded through a pattern process to rapidly create digitally decorated simulated tubing, and/or other unique three-dimensional shapes includes a foldable blank of a flat sheet of material with a plurality of fold lines formed into the flat sheet of material to allow the foldable blank, when folded, to configure at least one post which replicates extruded plastic or metal tubing. The post may define an elongated interior configured to receive an elongated support, after the folding along the fold lines. In a plurality of foldable blanks, each foldable blank including a flat sheet of material, and a plurality of fold lines formed into the flat sheet of material, the flat sheets of material are each foldable along their respective fold lines to configure a plurality of elements fittable together to form a standing display.

6 Claims, 14 Drawing Sheets

1300

SHEET MATERIAL FOLDABLE TO FORM THREE-DIMENSIONAL SIGNAGE

TECHNICAL FIELD

The present invention generally relates to a sheet material foldable to form three-dimensional signage.

BACKGROUND DISCUSSION

Today's Post and Panel Signage installations typically consist of a decorated rigid panel substrate that is held vertically by one or between a plural of vertical posts. These posts are typically made of either extruded aluminum tube, extruded steel tube, extruded polyvinyl chloride (PVC), or chemically-treated lumber. In cases where a less rigid decorated panel is used, additional supports called "rails" may be run between the vertical posts and along the top and bottom of the decorated sign panel substrate to add rigidity. The component materials used to create the rails typically match whatever material is specified for the vertical posts.

However, should a color other than each materials' raw finish be desired, each component must be painted in a process typically requiring scuffing, etching, rotating each component while applying three coats of primer (including three drying times), three coats of finish color (including three drying times), then adding a coat of UV protectant if required. This painting process can take hours to days, depending on the quality of the desired finish. Much of this painting is done by hand. In cases where a Sign Frame Kit is purchased, the kit consists of one of the traditional materials mentioned above, but arrives in a fabricated form, and in either a raw color state, or in a factory painted finish, usually in a black or white color. Additionally, it is known that PVC skin shapes are being produced that interlock together to "skin" the exterior of lumber posts. These PVC pieces come as either 4 pieces and lock around the four length sides of lumber, or as a formed C shape, with a second piece that snaps or slides together to create a 4th side.

SUMMARY

A foldable blank according to the present disclosure includes a flat sheet of material and a plurality of fold lines formed into the flat sheet of material. The flat sheet of material is foldable along the fold lines to configure at least one elongated tube similar in appearance to extruded plastic or metal tube shapes. The interior of the elongated tube may be configured to receive an elongated support. The foldable blank's perimeter is formed into a "pattern" shape that, when used with the formed fold lines, the substrate folds into a polygon shape, or folds to perfectly skin over top of an existing polygon shape.

According to another aspect of the present disclosure, there are blank or solid color faces on the flat sheet of material, where color, graphics, text, and/or UV coatings are digitally printed thereon, and the flat sheet of material further configures into a polygon shape, with the digitally printed decoration facing outward on one or a plural of polygon faces. According to another aspect of the present disclosure, a process is described where a computer program is used to save and recall specific designed patterns. These programs are used to rapidly reproduce saved patterns through automated machine-based systems.

According to an additional aspect of the present disclosure, the flat sheet of material further configures an openable box supported by the at least one post after the folding along the fold lines, and/or there are press through indicia bonded to the flat sheet of material.

In a plurality of foldable blanks according to the present disclosure, each foldable blank includes a flat sheet of material, and a plurality of fold lines formed into the flat sheet of material. The flat sheets of material are each foldable along their respective fold lines to configure a plurality of elements fittable together to form a standing display.

According to another aspect of the present disclosure, the flat sheets of material include a first flat sheet of material foldable along its respective fold lines to configure a post and a second flat sheet of material foldable along its respective fold lines to configure a polygon-shaped display portion. The post configured by the first flat sheet of material after the folding along its respective fold lines defines a lateral opening, and the polygon-shaped display portion configured by the second flat sheet of material after the folding along its respective fold lines includes a first side configured to be partially inserted into the lateral opening.

According to an additional aspect of the present disclosure, the flat sheets of material further include a third flat sheet of material foldable along its respective fold lines to configure a second post defining a second lateral opening, and the polygon-shaped display portion configured by the second flat sheet of material after the folding along its respective fold lines includes a second side configured to be partially inserted into the second lateral opening.

According to still another aspect of the present disclosure, the flat sheets of material include a first flat sheet of material foldable along its respective fold lines to configure a post and second and third flat sheets of material foldable along their respective fold lines to configure a top rail support and a bottom rail support, said top rail support and said bottom rail support configured to be supported by the post and configured to support a sign.

According to yet another aspect of the present disclosure, the flat sheets of material further include a fourth flat sheet of material foldable along its respective fold lines to configure a second post used as support for the rails and sign blank at the opposite end of configuration described in the preceding paragraph.

DETAILED DESCRIPTION

The present application discloses exemplary embodiments of a signage system in which rigid sheet stock is fabricated into foldable pattern shapes that replicate "unraveled" versions of the faces of each post, rail, and/or sign blank. Even entire "post and panel systems" and "post and rail systems" can be unraveled into flat patterns that can be laid out and fabricated from a single rigid substrate panel. Each pattern consists of a specific perimeter shape and specific fold lines. Edges are fabricated with various angles to allow the system to fit together seamlessly and in an aesthetically pleasing way. Each pattern is rapidly decorated when in a flat state using digital printing processes, nearly instantly applying color, graphics, text, and/or UV coatings, to every face of the posts, rails, and/or sign blank. After the flat sheets are formed, the flat sheets can be stacked and sent to a third party for the digital printing. Patterns are then folded into the finished 3 dimensional shapes of the component or complete system they represent. The flat sheets may also be assembled and packaged to create a UPS shippable complete kit. With this process and product, a drastic improvement in speed of production, exterior durability, and aesthetics, can be achieved. This technology may also be applied to other new and novel uses, such as digitally printed and foldable mail boxes, privacy fences, or dog houses, to name but a few. Additionally, patterns may be created from any digitally-printed substrate, where fold lines and perimeter shapes are specifically designed and fabricated, to perfectly skin over top of an existing polygon shape, like the length and top faced of a sign post.

Foldable Structures

Figure 1:
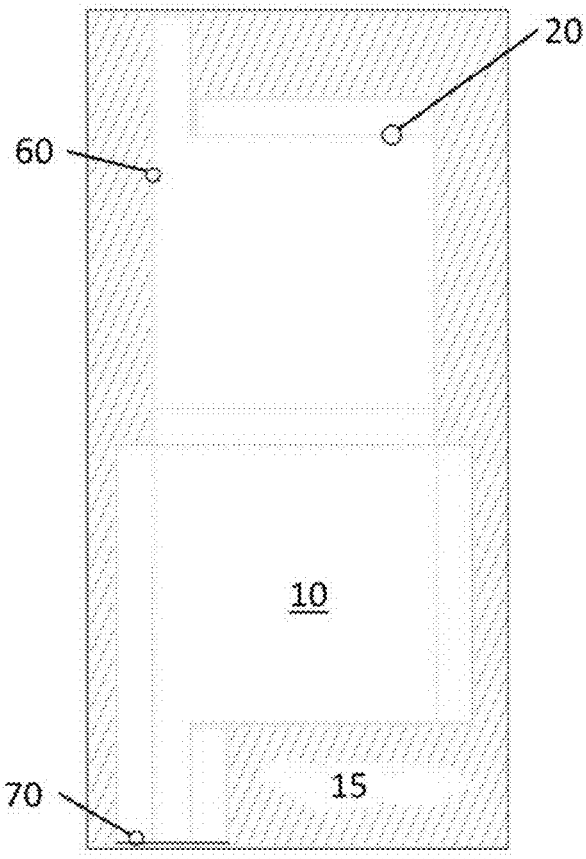
FIG. 1 illustrates a plan view of an embodiment of a foldable blank.

FIG. 1 illustrates an exemplary embodiment of a foldable blank according to the foregoing. The foldable blank is initially provided as a flat sheet of material 10. The material can be made from, but should not be limited to, cardboard, corrugated plastic (e.g., high-density polypropylene or polyethylene), wood cores (e.g., interior or exterior plywood, particle board, high density composites, etc.), foams, vinyl, solid plastic materials, etc. Each of these materials may be used with an optional laminated or painted outer surface or surfaces such as paint, painted aluminum, vinyl, films or any other planar material that will keep its shape after folding the material into a three-dimensional structure within expected tolerances, with the resultant three-dimensional structure being relatively sturdy. The foldable blank can be incorporated into a rectangular sheet from which it is punched out, cut (e.g., laser cut, router cut, saw blade cut, etc.) and separate from excess material 15, or can be provided preformed rather than punched out.

Figure 3:
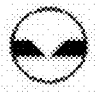
FIG. 3 illustrates a cross-section of a fold line.
Figure 4:
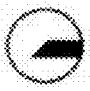
FIG. 4 illustrates a cross-section of an angle edge.
Figure 2:
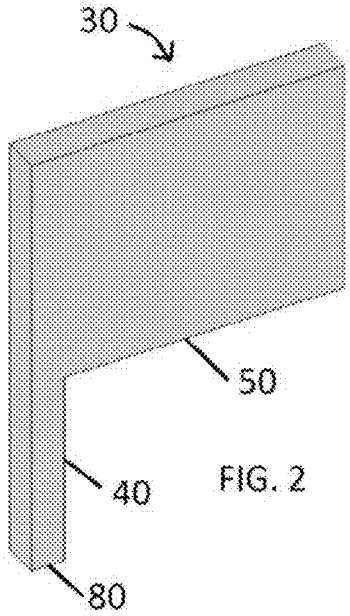
FIG. 2 illustrates a perspective view of the FIG. 1 foldable blank after folding.

Formed into the flat sheet of material 10 are a plurality of fold lines 20. The fold lines 20 are configured to allow for folding of the material 10 there along at an angle of approximately 90° along each fold line 20, although other angles can be used (e.g., 45° for octagonal signs or sign posts, 22.5° 16 sided signs or sign posts, for example). The fold lines 20 can be, for example, scored lines, lines of weakening, routed angled cuts, saw angled kerf cuts, etc., such as shown in FIGS. 3 and 4, for example. When folded along the fold lines 20, the flat sheet of material will configure a three-dimensional (3D) structure 30, particularly of a complex, multi surface shape (e.g., more than a six-sided box), as illustrated in FIG. 2, including an elongated tube, similar in appearance to extruded plastic or metal tube shapes, and a polygon-shaped display portion 50 supported by the post 40. In the embodiment, the elongated tube is an elongated post 40 defines an elongated interior configured to receive an elongated support. In some of the exemplary embodiments depicted in this application, the fold lines are configured by mirror-image intermittent edges each formed to make a 45°/135° angle with the main surfaces, as illustrated in FIG. 3, so that the folding can only be easily performed in a predetermined direction, and are schematically illustrated as broken lines in FIG. 1.

Figure 5:
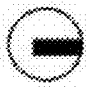
FIG. 5 illustrates a cross-section of a straight edge.

In one embodiment, the edges configured to meet another edge, such as the edge 60, are formed to make a 45°/135° angle with the main surfaces (after punching if incorporated into a rectangular sheet) as illustrated in FIG. 4, though of course other angles and shapes (ovoid, polygonal ogee or other complex shapes) for autistics or connection with other parts of the sheet or other objects are possible. Furthermore, the edges configured to be free edges after folding, such as the edge 70, are formed to make a 90° angle with the main surfaces (after punching if incorporated into a rectangular sheet) as illustrated in FIG. 5. In all the embodiments depicted in this application, each edge formed to make a 45°/135° angle with the main surfaces (after punching if incorporated into a rectangular sheet) is schematically illustrated as a relatively thin line, while each edge formed to make a 90° angle with the main surfaces (after punching if incorporated into a rectangular sheet) is schematically illustrated as a relatively thick line. In some the exemplary embodiments, the seams formed by mating edges can be kept more securely closed by, for example, an adhesive, welds (ultrasonic or otherwise), fasteners, magnets, or clips.

The flat sheet of material 10 can be provided with graphics digitally preprinted on or laminated on at least a portion thereof. Graphics may be applied to either face of the material 10. In the embodiment, the graphics are provided on the main face which will be on the exterior of the resultant three-dimensional structure after folding. The resultant three-dimensional structure after folding will therefore be usable as a display sign displaying the graphics.

After folding, a post 40 will have an opening 80 opening to the interior thereof. The post 40 can be placed over top of an elongated support, such as a piece of lumber, an elongated tube, or a ground-inserted steel spike, via the opening, providing for additional support of the structure and/or allowing the structure to appear free-standing in some embodiments, or stand on its own. The panel can also be configured to have enough rigidity such that the folded post or posts can be buried directly in the ground for installation. The foldable post can also be configured to accommodate, for example, post caps, which may be provided by a third party. The fold lines defining the post can also be aftermarket fabricated to create a system in which one size post fits any size display panel, by allowing for snipping to a fold line then breaking a section of the foldable panel away.

Figure 6:
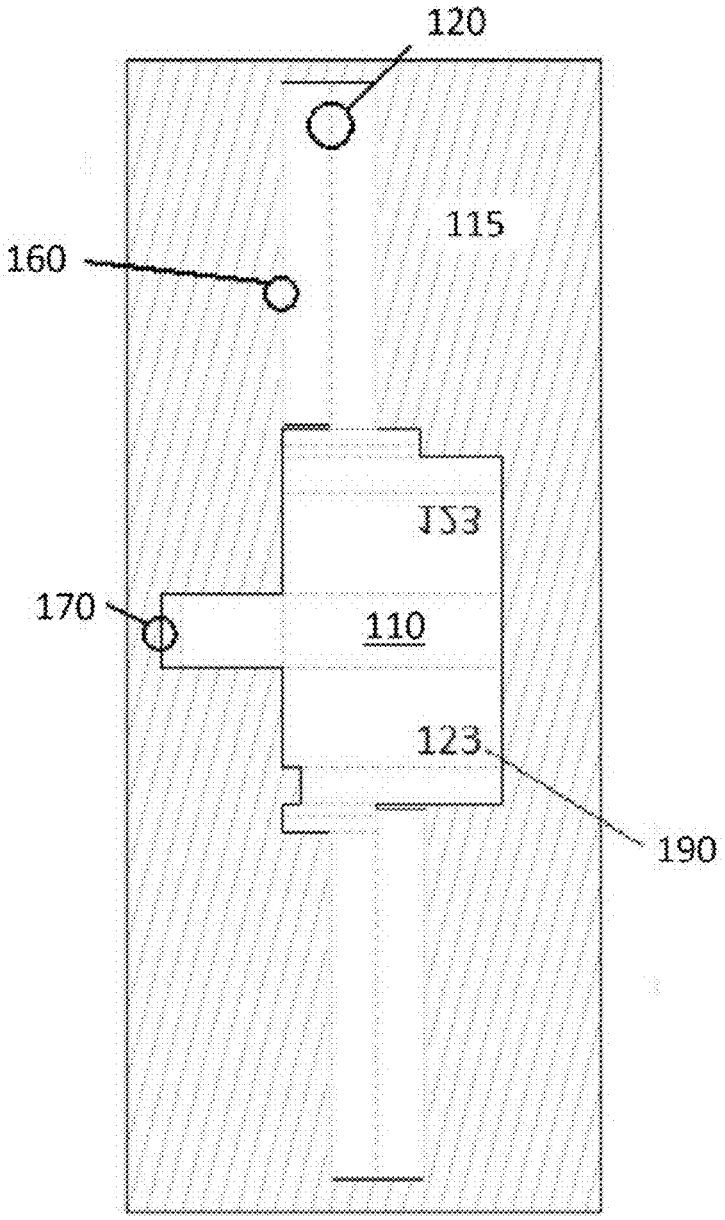
FIG. 6 illustrates a plan view of an additional embodiment of a foldable blank.
Figure 7:
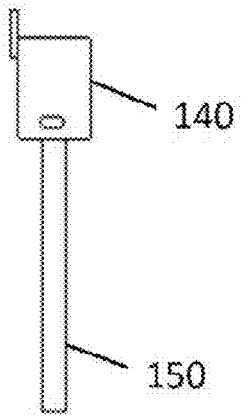
FIG. 7 illustrates a front view of the FIG. 6 foldable blank after folding.
Figure 8:
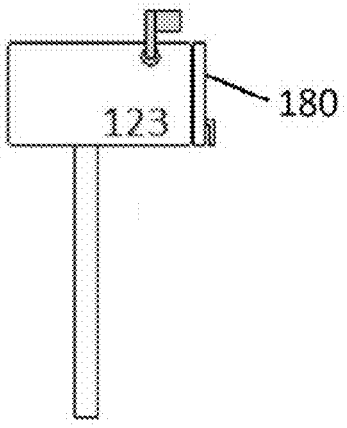
FIG. 8 illustrates a side view of the FIG. 6 foldable blank after folding.

The embodiment of FIGS. 6-8 is similar to that of FIGS. 1 and 5, with the main difference being that, instead of configuring a display portion, the resultant three-dimensional structure configures an openable box. The resultant three-dimensional structure in the embodiment can thus be used, for example, as a mail box.

As illustrated in FIG. 6, the flat sheet of material 110, optionally removed from excess material 115, includes fold lines 120 (dashed to show folds on one side and dots to show folds on the other side), edges 160 which make a 45°/135° angle with the main surfaces, and edges 170 which make a 45°/135° angle with the main surfaces. The resultant three-dimensional structure illustrated in FIGS. 7 and 8 includes hollow post 150 supporting a box 140, which can be closeable and openable by the addition of a separate door 180. Note that multiple fold lines formed by narrow angled cuts can form a curved or tambour surface, such as seen on traditional mailbox tops. Furthermore, in addition to being provided with pre-printed digital graphics and an attached flag (which can also be attached after the three-dimensional structure is formed) on the flat sheet of material, the material can also be provided with press through indicia 190 bonded to the flat sheet of material displaying, for example, the house number associated with the mailbox.

Figure 10:
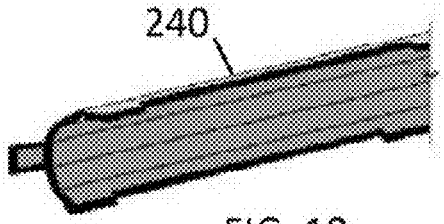
FIG. 10 illustrates a perspective view of a portion of the FIG. 9 foldable blank after partial folding.
Figure 11:
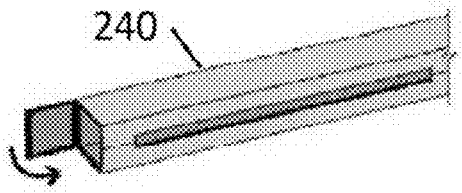
FIG. 11 illustrates a perspective view of a portion of the FIG. 9 foldable blank after additional folding.
Figure 12:
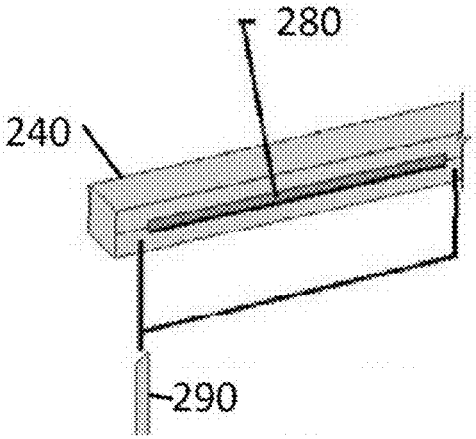
FIG. 12 illustrates a perspective view of a portion of the FIG. 9 foldable blank after final folding.

In other embodiments, a plurality of flat blanks, each configuring a post when folded, are fittable with other elements to configure the three-dimensional structure. The flat sheet 200 of the FIG. 9 embodiment includes fold lines 220, a post-top 260 which make a 45°/135° angle with the main surfaces, and offset edges 270 which make a 90° angle with the main surfaces to form a butt joint when folded, although various angles and even complex profiles to interlocking surfaces are contemplated. When folded as illustrated in FIGS. 10-12, a panel insertion notch 280 is formed in an elongate surface of the resultant post 240. Furthermore, when a corrugated substrate is used, dowel pins 290 may be inserted into the flutes to lock the edges together, as one example of a fastener.

Figure 9:
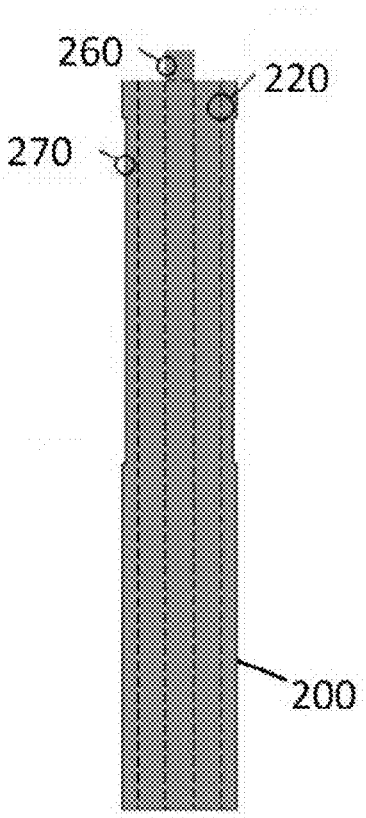
FIG. 9 illustrates a plan view of an additional embodiment of a foldable blank.
Figure 13:
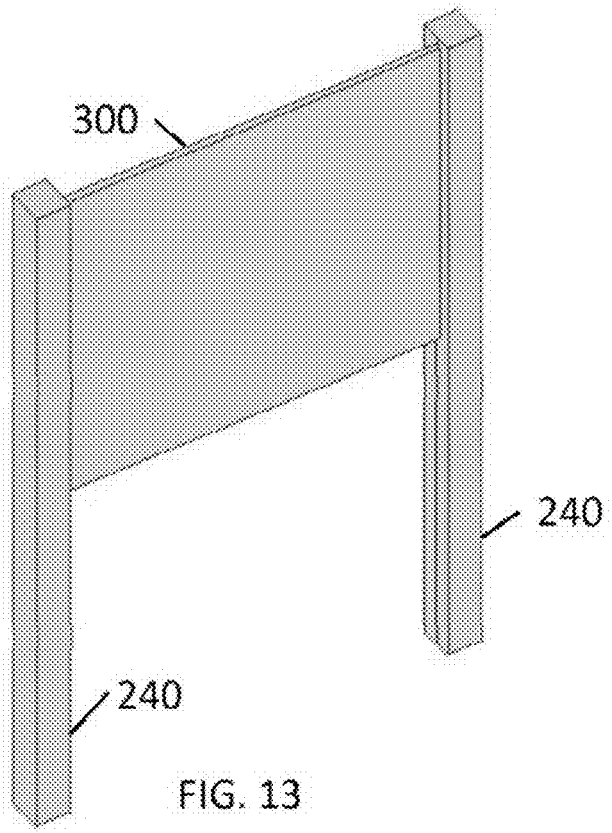
FIG. 13 illustrates a perspective view of two of the FIG. 9 foldable blank after final folding supporting a sign.

FIG. 13 illustrates an example of a system using two posts 240 from the folded structure shown in FIG. 9. A single panel substrate 300 is inserted into and supported by the panel insertion notches 280 of the two posts 240. Graphics may be pre-printed digitally on the material forming the posts 240 and the substrate 300 in a manner in which they form a continuous graphic image when assembled.

Figure 14:
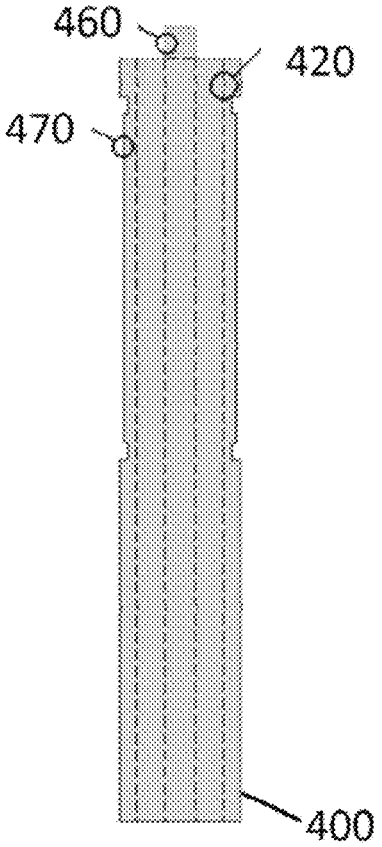
FIG. 14 illustrates a plan view of an additional embodiment of a foldable blank.
Figure 15:
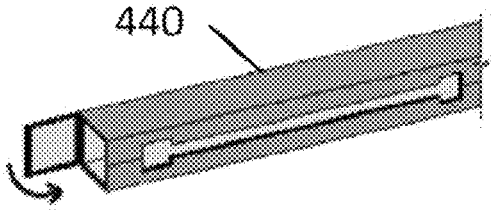
FIG. 15 illustrates a perspective view of a portion of the FIG. 14 foldable blank after partial folding.
Figure 16:
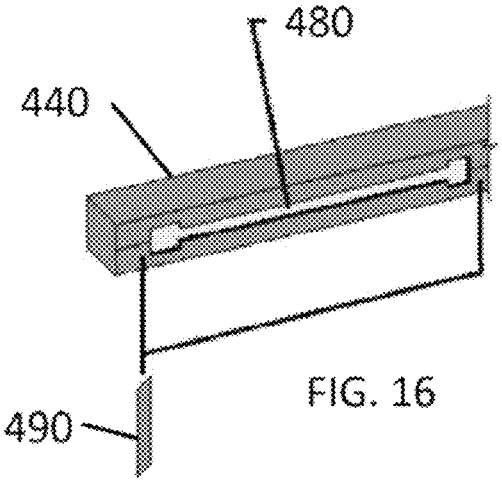
FIG. 16 illustrates a perspective view of a portion of the FIG. 16 foldable blank after final folding.

FIGS. 14-16 illustrate a post 440 formed from a flat sheet of material 400 and which is identical to that of FIGS. 9-12, except that the panel insertion notches 480 have larger width portions at their top and bottom ends, as illustrated in FIGS. 15 and 16. The flat sheet of material 400 includes fold lines 420, edges 460 which make a 45°/135° angle with the main surfaces, and edges 470 which make a 45°/135° angle with the main surfaces. Furthermore, when a corrugated substrate is used, dowel pins 490 may be inserted into the flutes to lock the edges together.

Figure 17:
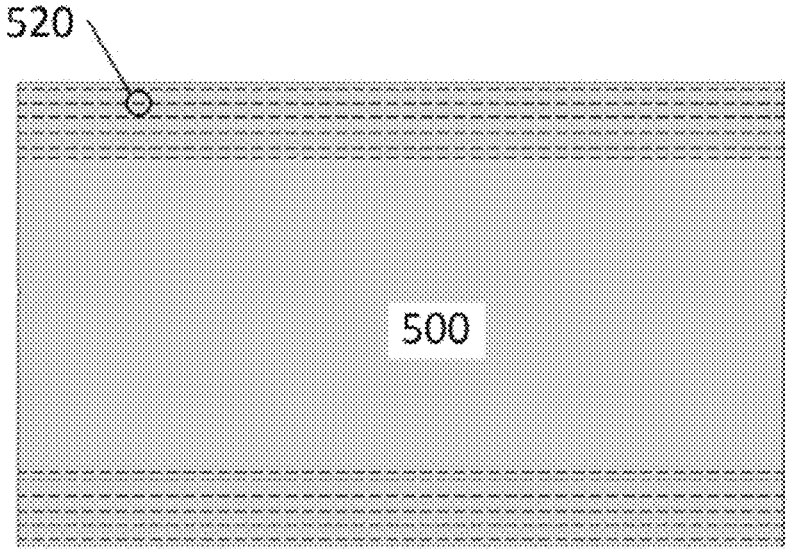
FIG. 17 illustrates a plan view of an additional foldable blank usable with the FIG. 14 foldable blank.
Figure 18:
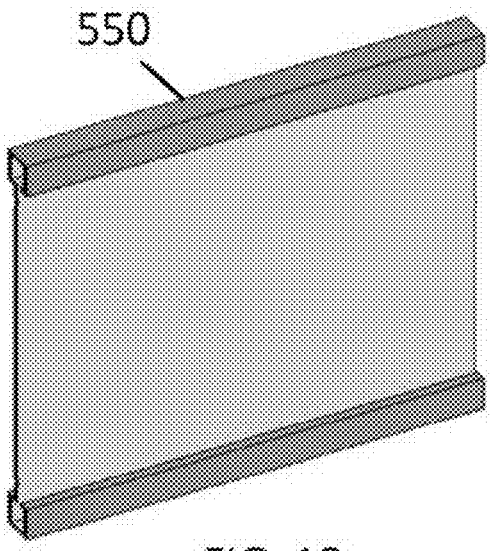
FIG. 18 illustrates a perspective view of the FIG. 14 foldable blank after folding.
Figure 19:
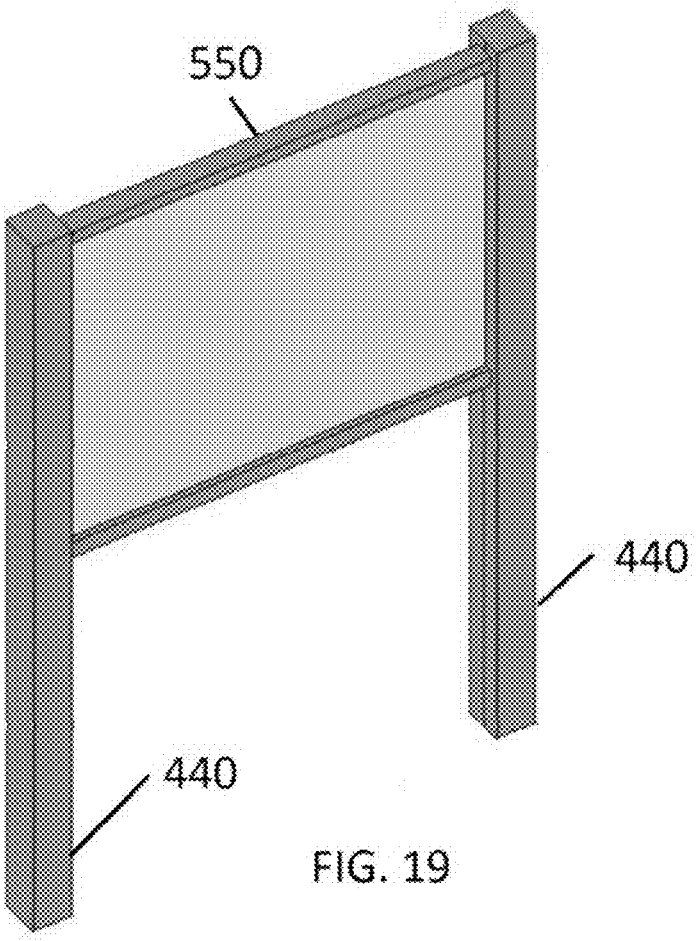
FIG. 19 illustrates a perspective view of two of the FIG. 14 foldable blanks after folding fitted with the FIG. 17 foldable blank after folding.

Posts 440 are configured to work with a stringer panel 550 illustrated in FIG. 18, which is itself formed from a foldable flat sheet 500 illustrated in FIG. 17 having fold lines 520 that form the square end tube structures of the stringer panel 550 shown in FIG. 18, for added strength against bending. FIG. 19 illustrates a system in which such a stringer panel 550 is supported by two such posts 440. Graphics may be pre-printed digitally on the material forming the posts 440 and the substrate 500 in a manner in which they form a continuous graphic image when assembled.

Figure 20:
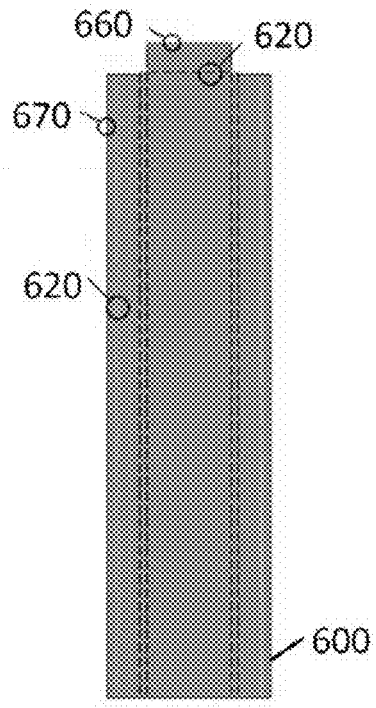
FIGS. 20 and 21 illustrate plan views of additional foldable blanks usable together to form a post.
Figure 21:
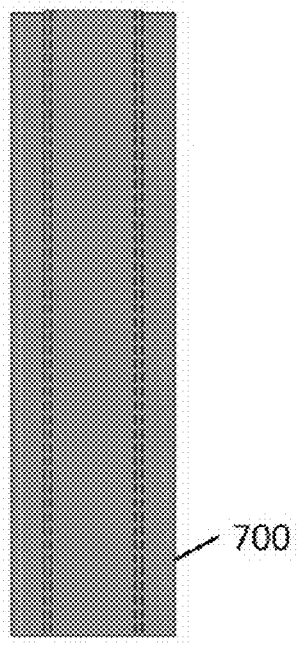

Another embodiment allows for fencing to be produced. As illustrated in FIGS. 20 and 21, a front post face flat sheet 600 and a rear post face flat sheet 700 are provided. The front post face flat sheet 600 includes fold lines 620, edges 660 which make a 45°/135° angle with the main surfaces, and edges 670 which make a 90° or 45°/135° angle with the main surfaces, depending on whether a butt or angled joint is preferred, for example. Corresponding fold lines and edges are also provided on rear post face flat sheet 700.

Figure 22:
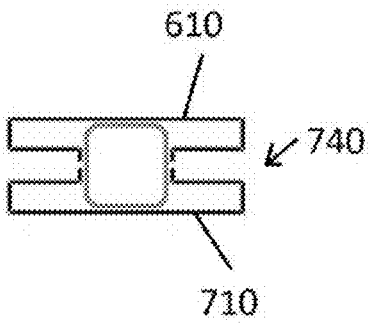
FIG. 22 illustrates a cross-section view of the foldable blanks of FIGS. 20 and 21 used together to form a post.
Figure 23:
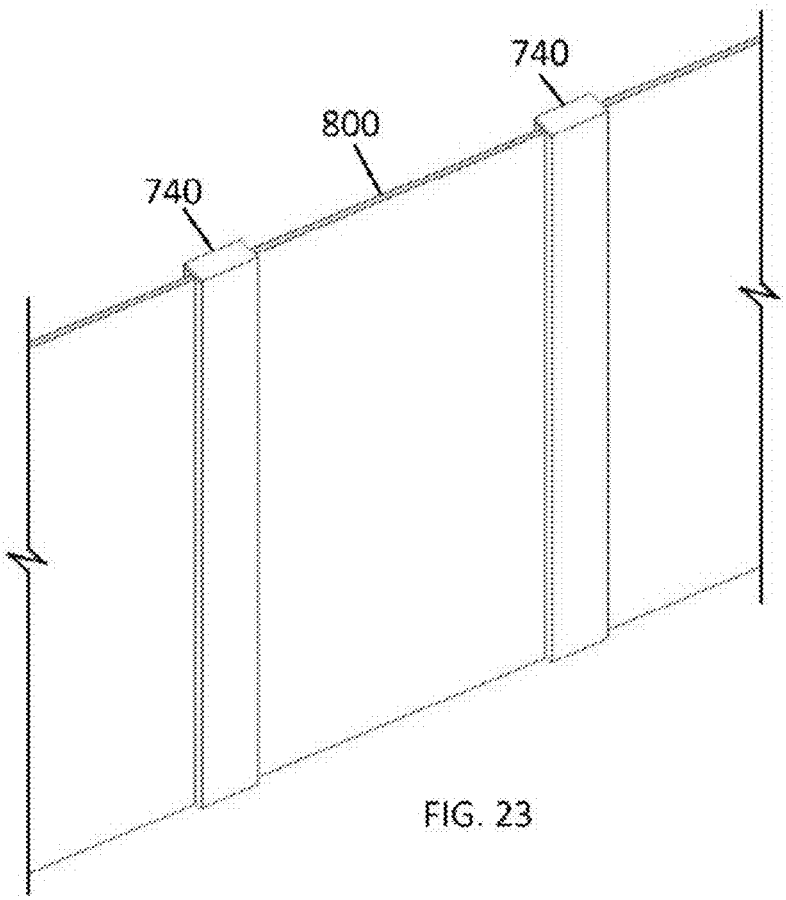
FIG. 23 illustrates a perspective view of a system using a plurality of the FIG. 22 posts.

FIG. 22 illustrates a cross-sectional view of the resultant front post face 610 and rear post face 710 fitted together to create a cover for a post 740. The faces are to the post by, for example, screws, adhesive, or clips, or by an interlocking profile on the edges 270. As illustrated in FIG. 23, substrate panels 800 can be placed between adjacent posts 740 to be supported thereby. Graphics may be pre-printed digitally on the material forming the posts and the substrate in a manner in which they form a continuous graphic image when assembled.

Figure 24:
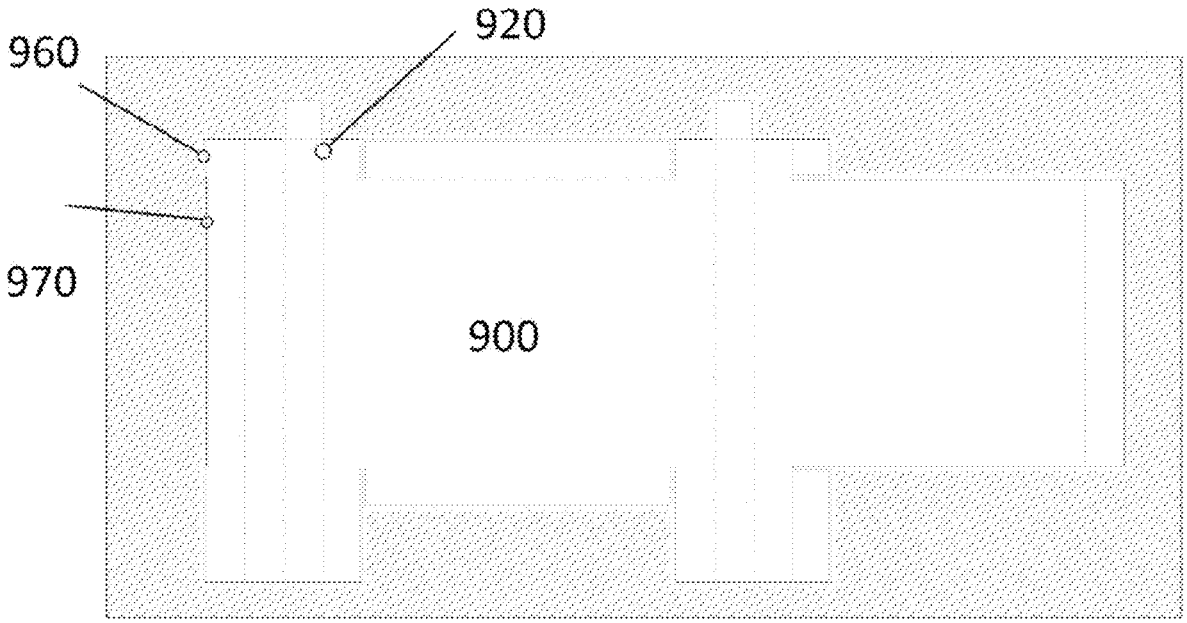
FIG. 24 illustrates a plan view of an additional embodiment of a foldable blank.
Figure 25:
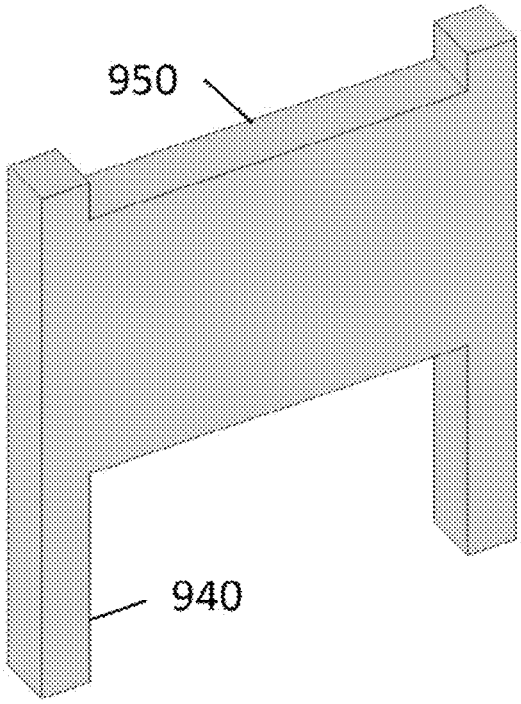
FIG. 25 illustrates a perspective view of the FIG. 24 foldable blank after folding.

A multi-post system can also be configured by a single flat sheet of material 900 including fold lines 920, edges 960 which make a 45°/135° angle with the main surfaces, and edges 970 which make a 90° or 45°/135° angle with the main surfaces, as illustrated in FIG. 24. The resultant three-dimensional structure illustrated in FIG. 25 includes rectangular display 950 between two hollow posts 940. As in the other embodiments, the material 900 can be provided with pre-printed digital graphics, and the posts 940 can be supported by inserts such as lumber, an elongated tube, or a ground-inserted steel spike.

Figure 26:
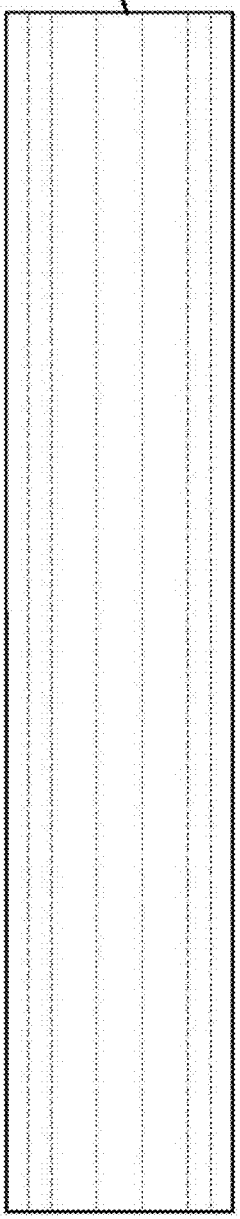
FIG. 26 illustrates a plan view of a foldable blank usable to form top and bottom supports.
Figure 28:
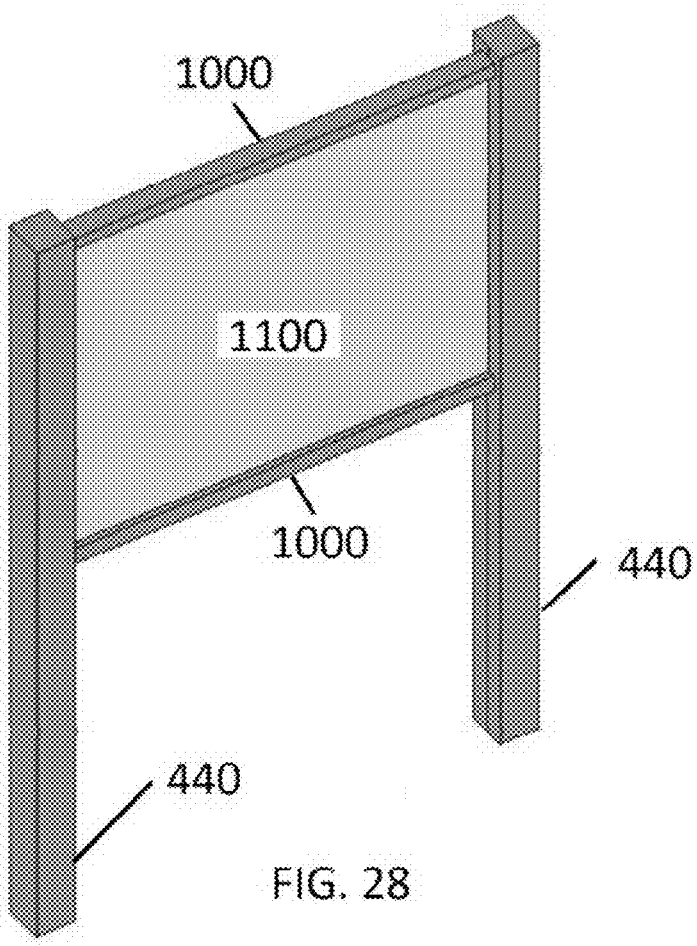
FIG. 28 illustrates a perspective view of two of the FIG. 14 foldable blanks after folding fitted with the FIG. 17 foldable blank after folding.
Figure 27:
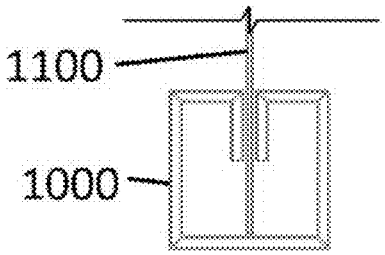
FIG. 27 illustrates a side view of the FIG. 26 foldable blank after folding supporting a top or bottom of a sign.

As illustrated in FIG. 28, posts 440 can also work with top and bottom supports 1000, foldable from flat sheets as illustrated in FIG. 26, and supporting a separate sign 1100 as illustrated in FIG. 27. As in the other embodiments, the material of the posts 440 and supports 1000 can be provided with pre-printed digital graphics, and the posts 440 can be supported by inserts such as lumber, an elongated tube, or a ground-inserted steel spike.

System for Fabrication of Foldable Structures

Figure 29:
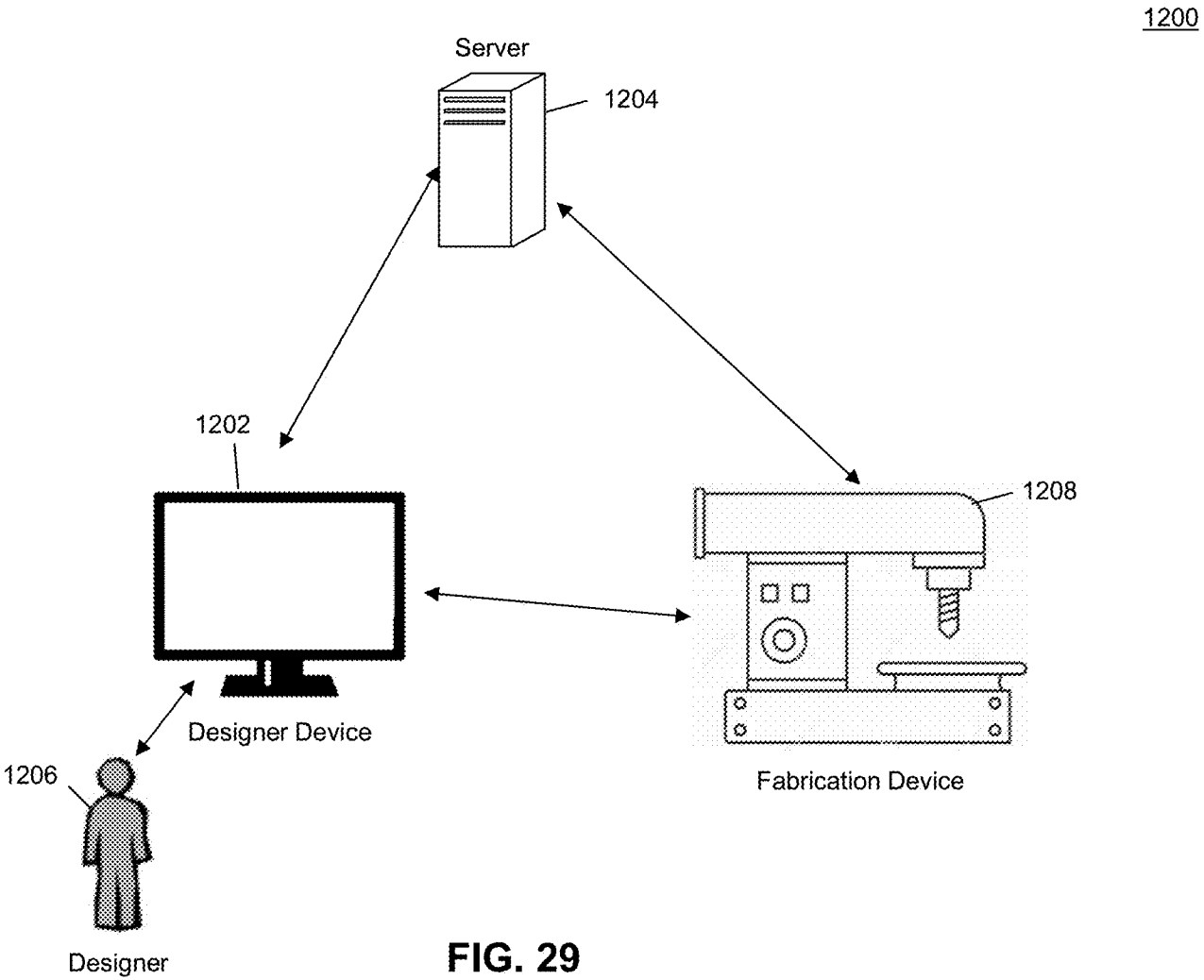
FIG. 29 depicts an illustrative system for fabricating foldable structures described herein.

FIG. 29 depicts an illustrative system 1200 for fabricating foldable structures such as the foldable structures described above. The system 1200 may include a designer device 1202 for a designer 1206, a server 1204, and a fabrication system 1206.

Figure 31:
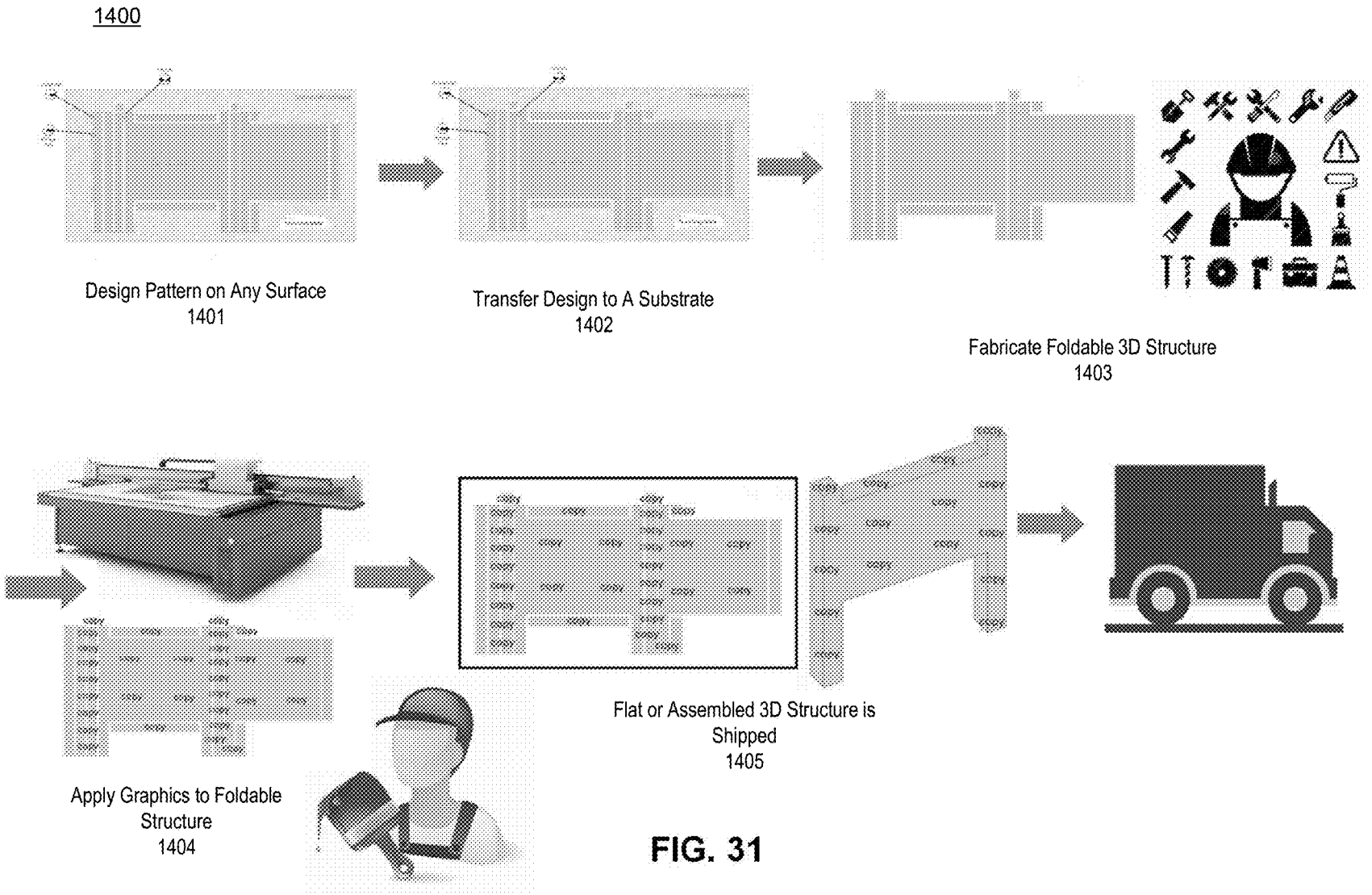
FIGS. 31-33 depict illustrative flow charts for designing and fabricating a foldable structure.

The designer device 102 may be responsible for interfacing with a designer 1206 and executing software for designing foldable structures. The designer device 1202 may include one or more components of computer system 3100 discussed below in FIG. 31. As an example, the designer device 1202 may be a computer (e.g., personal computer, laptop computer), tablet computer, netbook, server, smartphone, or any other computing device such as shown in FIG. 31. The designer device 1202 may include a processor and memory configured to execute computer-executable code. The designer device 1202 may communicate with the server 1204 and fabrication device 1208 via one or more wired and/or wireless networks (e.g., an internet protocol network, a cellular network, a fiber network, a coaxial network, etc. and/or any combination thereof). Using one or more of these networks, the designer device 1202 may download the software for designing foldable structures from the server 1204.

The designer device 1202, via execution of the software, may generate one or more user interfaces to enable the designer 1206 to design a custom foldable structure. For instance, the user interfaces may provide menus to select prestored templates for designing foldable structures and/or elements or components thereof for customization by the designer 1206. The prestored templates may include preset arrangements of one or more of the design features of the folding structures described above in connection with FIGS. 1-28. Design features may include folding lines, score lines, size, background color, graphic area, indicia area, openings, panel insertion notch, material, dowel pins, and/or any other design features discussed above. The various design features may be visually indicated in the template. For instance, fold lines may be represented as dotted lines while edges may be represented as solid lines. Additionally, different texture or shading may be used to indicate the excess material. Each of the various design features may also be labeled as well as indicate various technical specifications such as length, angle of cut, color, material, indicate which edges connect to one another, direction of fold, and the like.

The templates may also include multiple views of various stages or foldable configurations of the foldable structure, which may be displayed to the designer 1206. As an example, one template may be associated with the foldable structure depicted in FIGS. 1 and 2. In such an example, a first view of the template may be a flat sheet of material 10 with various design features (e.g., edge 60, edge 70, fold lines 20, excess material 15) marked and/or otherwise indicated as shown in FIG. 1. A second view of the template may be the foldable structure as fully folded to form 3D structure 30 as shown in FIG. 2. The second view may also include various indications of design features that were depicted in the first view (e.g., a graphic area). Additionally, the second view may include indications of design features that result from the complete folding of the foldable structure (e.g., opening 80, post 40, display portion 50, etc.). The template may also include one or more intermediary views (e.g., a third view) of the foldable structure partially folded. In some cases, the view may be displayed as a result of the designer 1206 selecting a particular component and a fold instruction. The designer device 1202 may permit the user to switch between the views and/or display multiple views simultaneously.

The designer 1206 may customize the template to reflect the designer's 1206 design and aesthetic preferences. For instance, the designer 1206 may adjust one or more of size measurements, color, locations of design features (e.g., location of folding lines, location of graphics area, location of indicia, location of dowel pins, location of openings, location of panel insertion notch, etc.), label, angle of cut, fold direction, and the like. For instance, the designer 1206 may select graphic designs or indicia to be displayed in the graphical areas (e.g., panel portions of the foldable structure) or indicia areas, respectively. The graphic designs or indicia may be selected from a list of preset options or retrieved from a file. The designer device 1202 may permit the designer to enlarge, reduce, crop, and/or rotate the selected graphic or indicia. After each adjustment, the depicted design may be updated to account for the adjustment.

In one or more arrangements, the software for designing foldable structures may account for shadow on a first portion of the completely folded structure created by a second portion of foldable structure and the position of a light source (e.g., a light fixture or sun position at a particular time of day). As an example the first portion may be a portion of a panel having a graphic area and the second portion may be a rail or stringer above the panel. When light impinges on the rail or stringer, the rail or stringer may cause a shadow to be produced on the panel, which may produce an undesirable shadow on a graphic area. The user interface may permit the designer 1206 to select a position of a light source and the resulting shadow may be calculated and displayed by the designer device 1202. The designer 1206 may then adjust the graphic panel (e.g., by an offset distance) such that the graphic area is no longer covered by the shadow. In some cases, selection of the sun's position may be based on a selected time day and the resulting shadow may account for the foldable structure's orientation relative to the earth (e.g., magnetic north).

In one or more arrangements, rather than selecting and modifying a preset template to create a custom design, the designer 1206 may create a custom design for the foldable structure from scratch using tools provided by the software for designing the foldable structure. For instance, the designer 1206 may select a blank material and add design features (e.g., foldable lines, cut angles, etc.) that, when folded, create the designer's 1206 desired 3D structure.

The server 1204 may be responsible for providing the software for designing foldable structures and updates thereto. The server 1204 may include one or more components of computer system 3100 discussed below in FIG. 31. The server 1204 may include a processor and memory configured to execute computer-executable code. The server 1204 may communicate with the designer device 1204 and fabrication device 1208 via one or more wired and/or wireless networks (e.g., an internet protocol network, a cellular network, a fiber network, a coaxial network, etc. and/or any combination thereof). The server 1204 may also be responsible for storing a repository of templates, graphic designs, and design features for access by the designer device 1202 and the fabrication device 1208.

As discussed above, the designer device 1202 may download the software from the server 1204. In one or more other arrangements, the designer device 1202 might not download the software from the server 1204. Instead, the server 1204 may execute the software and provide a web-based portal through which the designer 1206 may access the software using the designer device 1202.

The fabrication device 1208 may be responsible for fabricating the foldable structures from blanks using design plans created by the software for designing foldable structures. The fabrication device 1208 may include one or more components of computer system 3100 discussed below in FIG. 31. For instance, the fabrication device 1208 may include a processor and memory configured to execute computer-executable code. The fabrication system 1208 may communicate with the server 1204 and the designer device 1202 via one or more wired and/or wireless networks (e.g., an internet protocol network, a cellular network, a fiber network, a coaxial network, etc. and/or any combination thereof). In one example, the fabrication device may be a computer numerical control (CNC).

The software may use the customized design built from a template or from scratch to generate a design plan. The design plan may include one or more instructions for the fabrication device 1208 to execute such that a blank is imparted with design features desired by the designer 1206. For instance, the fabrication device 1208 may cut the blank to generate edges having a particular cut angle or holes, imprint with folding lines (e.g., crushing a portion to create a score line), and affix with selected graphic designs or indicia.

In some cases, the foldable structures may be made out of materials that are substantially more rigid than cardboard (e.g., PVC, wood, metal, etc.). These materials, unlike cardboard, may be extremely difficult for the fabrication device 1208 to crush to create folding lines. As a result, the fabrication system 1208 may create folding lines by partially cutting the rigid materials. To this end, the software for designing foldable structures may account for the partial cutting in the design process. For instance, the software may, if such a rigid material is selected, prevent designer 1206 from inserting folding lines that result from the crushing of the material along the folding line. Additionally, the software may permit the designer 1206 to select an option to partially cut the blank along a line to create a fold line. In such an instance, the software may treat each portion of the blank, which is separated by the partially cut fold lines, as a separate image.

Process for Fabricating and Forming Foldable Structures

A process for making the foldable blanks involves forming a specific perimeter shape and fold lines into a flat substrate, and then using digital printing technology to decorate the faces of the flat substrate, so that the flat substrate can be folded up into a specific, decorated, polygon shape. As discussed above, this created polygon shape may be planned as part of a structural support, or it may act as a means to rapidly decorate and perfectly "skin" a second structural polygon. Perimeter shapes, fold lines, and/or graphics may be saved and used as a "pattern" to recreate the decorated polygon rapidly through automated machinery.

Figure 30:
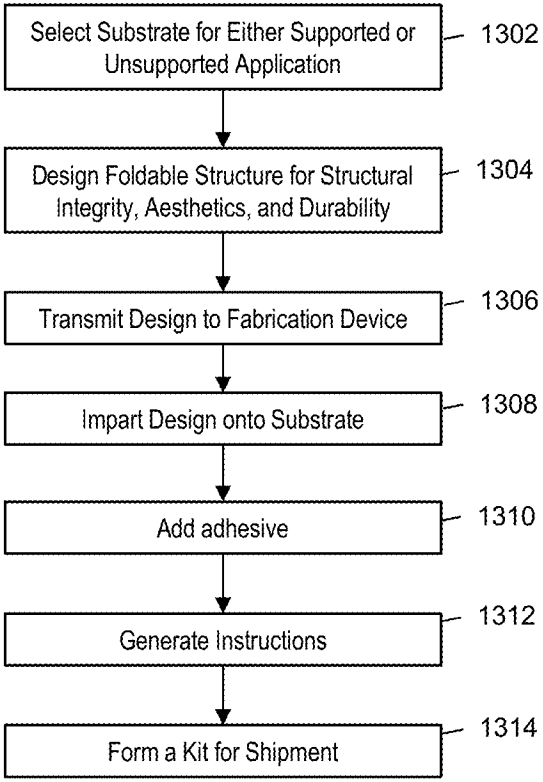
FIG. 30 depicts an illustrative flow chart for fabricating a foldable structure for subsequent assembly into a 3D structure.

FIG. 30 depicts an illustrative flow chart for fabricating a foldable structure for subsequent assembly into a 3D structure. The steps of the FIG. 30 may be performed by the system 1200. As an example, one or more of steps 1302-1306 may be performed by the designer device 1202 and one or more of steps 1308-1314 may be performed by the fabrication device 1208.

The method may begin at step 1302 in which the designer device 1202 may permit the designer 1206 to select a substrate (e.g., a material such as PVC, wood, metal, etc.) for either supported or unsupported application. A supported application may be an application in which the foldable structure is intended to be affixed to another structure after the foldable structure is completely folded into its 3D structure. For instance, the supported application might not be freestanding but may be designed to couple to another structure for support. As an example, a supported application may be when the foldable structure defines an opening that is intended to receive a post affixed to the ground. An unsupported application may be an application in which the foldable structure may be a standalone structure. The standalone structure may be freestanding or designed to be affixed to the ground (e.g., by burying a portion of a post of the 3D structure).

Templates for designing a foldable structure discussed above may be specific to whether the application is supported or unsupported. Specifically, because the design for a 3D structure's supported application may be different from the design for the 3D structure's unsupported application, the 3D structure may be associated with two different templates—one for a supported application and a different one for the unsupported application.

At step 1304, the designer device 1202 may, via the software application, permit the designer 1206 to create a design plan for a 3D structure while accounting for structural integrity, aesthetics, and durability. As an example, the designer 1206 may customize a 3D structure based on one of the templates specific to the application. For instance, the designer 1206 may select graphics or indicia for placement on various faces of the 3D structure. In response, the portions on the face of the blank that correspond to the various faces may be marked as the location for the selected graphic or indicia. As another example and as discussed above, the designer 1206 may design the foldable structure from scratch using tools provided by the software.

At step 1306, the designer device 1202 may transmit the designer's 1206 design plan for the foldable structure to the fabrication device 1206 for fabrication of the foldable structure. The design plan may be transmitted in the form of an electronic message via one or more wired and/or wireless networks.

At step 1308, the fabrication device 1208 may impart, based on the design plan, the design for the foldable structure onto the substrate to create the foldable structure. The fabrication device 1208 (e.g., a CNC) may drill, bore, cut, and mark a blank of the selected substrate in accordance with the design plan received from the designer device 1202. For instance, the fabrication device 1208 may cut the blank fully at a designed angle to create an edge. The fabrication device 1208 may also partially cut the blank to create fold lines if the material is more rigid than cardboard. The fabrication device 1208 may also drill holes to create, for example, a panel insertion notch 280. Additionally, the fabrication device 1208 may affix a graphic or indicia to various areas of the blank in accordance with the design plan.

At step 1310, the fabrication device 1208 may add adhesive to portions of the foldable structure cut from the blank. For instance, the template used to create the design may have designated specific areas (e.g., edges or faces) of the foldable structure to affix additional structural support or other items. In some cases, during the design process for the foldable structure, the designer 1206 may specify areas for adding adhesive.

At step 1312, the fabrication device may, based on the design plan, generate instructions for a user to assemble (e.g., fold) the foldable structure into its 3D structure. The instructions may include an order of folding the foldable structure. The instructions may also include where and how to couple two portions of the foldable structure together, which may be done via adhesive, screws, bolts, pop-rivets, sonic-welding, welding, banding, tapes, etc. The instructions may also include where to affix any additional graphics, indicia, or other items (e.g., mailbox flag). Additionally, for supported applications, the instructions may also inform the user how to couple the 3D structure to the supporting structure.

At step 1314, the system 1200 may form a kit for shipment. The kit may include the foldable structure, assembly instructions, graphics, indicia, other items (e.g., mailbox flag) as well as parts for assembling the 3D structure (e.g., screws, nuts, bolts, nails, adhesive, and the like). The kit may then be shipped to an end user. After the user receives the kit, the user may assemble the 3D structure in accordance with the instructions.

FIG. 31 depicts an illustrative flowchart 1400 for designing and fabricating a foldable structure. One or more of the steps of FIG. 31 may be performed by various devices described herein. The method may begin at step 1401 in which the designer 1206 may design a foldable structure using designer device 1202. For instance, the designer 1206 may determine the 3D look of the finished foldable structure, size of the foldable structure, quantity of faces of the foldable structure, substrate quality, fold lines, joint types, fastening systems, and/or support structures (if any). The designer 1206 may also select a fabrication process, fabrication tooling, and/or fabrication speed. The designer 1206 may also create a parts list and graphical art. At step 1402, the designer device 1206 may cause transfer of the design to a substrate (e.g., a blank). For example, cut and fold lines may be marked on the substrate by a printer coupled to the designer device 1202. At step 1403, the fabrication device 1208 may fabricate the foldable 3D structure. For instance, the fabrication device 1208 may receive the design from the designer device 1202. Based on the design, the fabrication device 1208 may cut the substrate to create edges, crush portions of the substrate to create fold lines, create fastening points, and affix fasteners to the fastening points. At step 1404, the fabrication device 1208, another device (e.g., a printer), or an artist may apply graphics to the foldable structure. At step 1405, the foldable structure may be shipped to a consumer. The foldable structure may be shipped in either an assembled or unassembled configuration.

Figure 32:
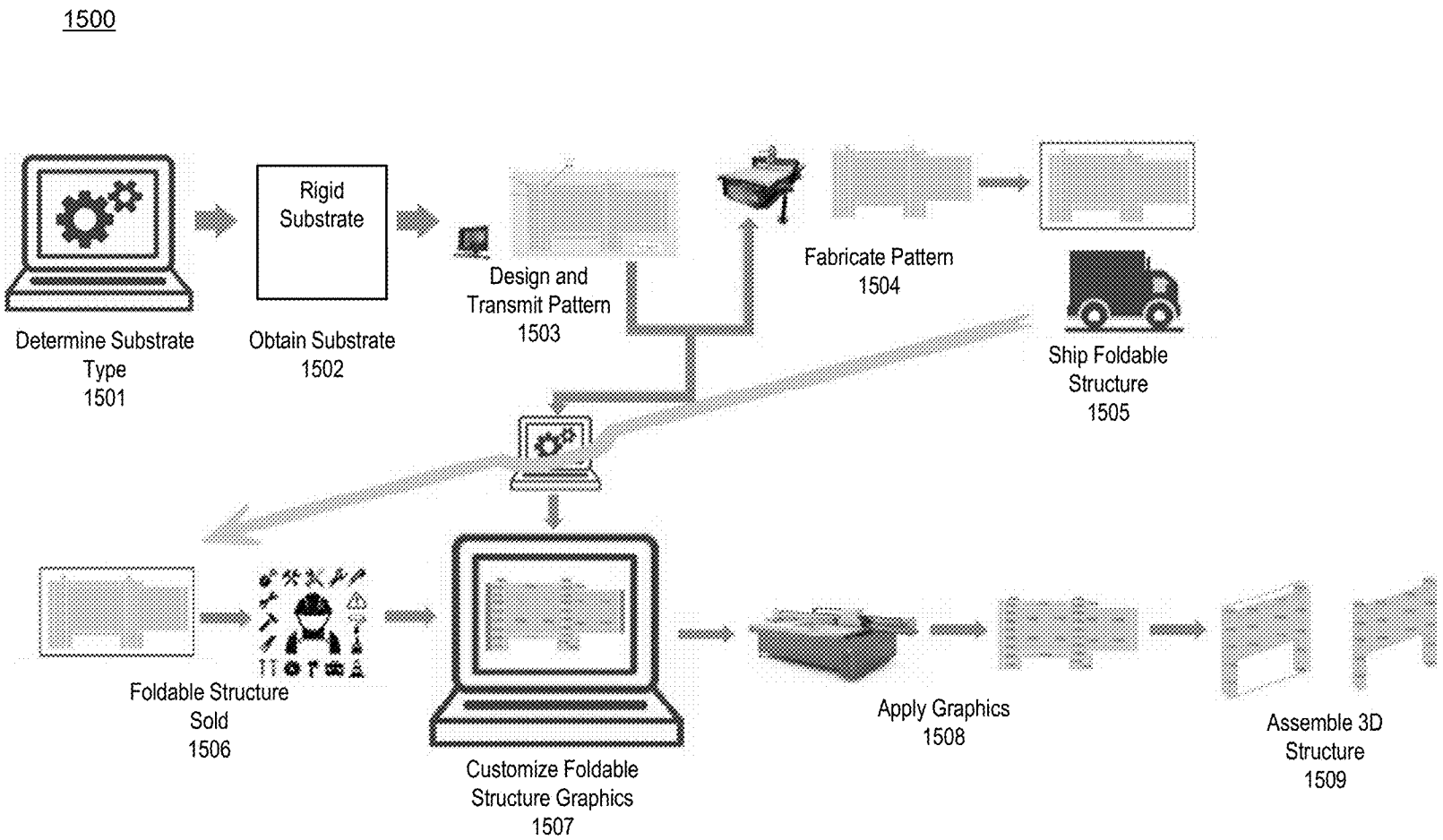

FIG. 32 depicts an illustrative flow chart 1500 for designing and fabricating a foldable structure. One or more of the steps of FIG. 32 may be performed by various devices described herein. The method may begin at step 1501 in which the designer 1206 may select materials for a foldable structure using designer device 1202. For instance, the designer 1206 may select materials for the foldable structure based on desired appearance, cost, durability, exterior lifespan, environment, rigidity, surface finish, dimensions, support structures, fasteners, fabrication restrictions, and/or material availability. At step 1502, a rigid substrate (e.g., blank) may be obtained. At step 1503, the designer 1206 may design a foldable structure using designer device 1202 and transmit the design to other devices. For instance, the designer 1206 may determine the 3D look of the finished foldable structure, size of the foldable structure, quantity of faces of the foldable structure, substrate quality, fold lines, joint types, fastening systems, and/or support structures (if any). The designer 1206 may also select a fabrication process, fabrication tooling, and/or fabrication speed. The designer 1206 may also create a parts list and graphical art. The designer device 1206 may transmit the device to fabrication device 1208 and/or to a remote computing device (e.g., a consumer's design device). At step 1504, the fabrication device 1208 may fabricate the foldable 3D structure. For instance, the fabrication device 1208 may receive the design from the designer device 1202. Based on the design, the fabrication device 1208 may cut the substrate to create edges, crush portions of the substrate to create fold lines, create fastening points, and affix fasteners to the fastening points. At step 1505, the foldable structure may be shipped to a store where a consumer, at step 1506, may purchase the foldable structure. At step 1507, the consumer may, using a designer device, customize the graphics for the foldable structure. At step 1508, the fabrication device 1208, another device (e.g., a printer), or an artist may apply the customized graphics to the foldable structure. At step 1509, the foldable structure may be assembled by the consumer.

Figure 33:
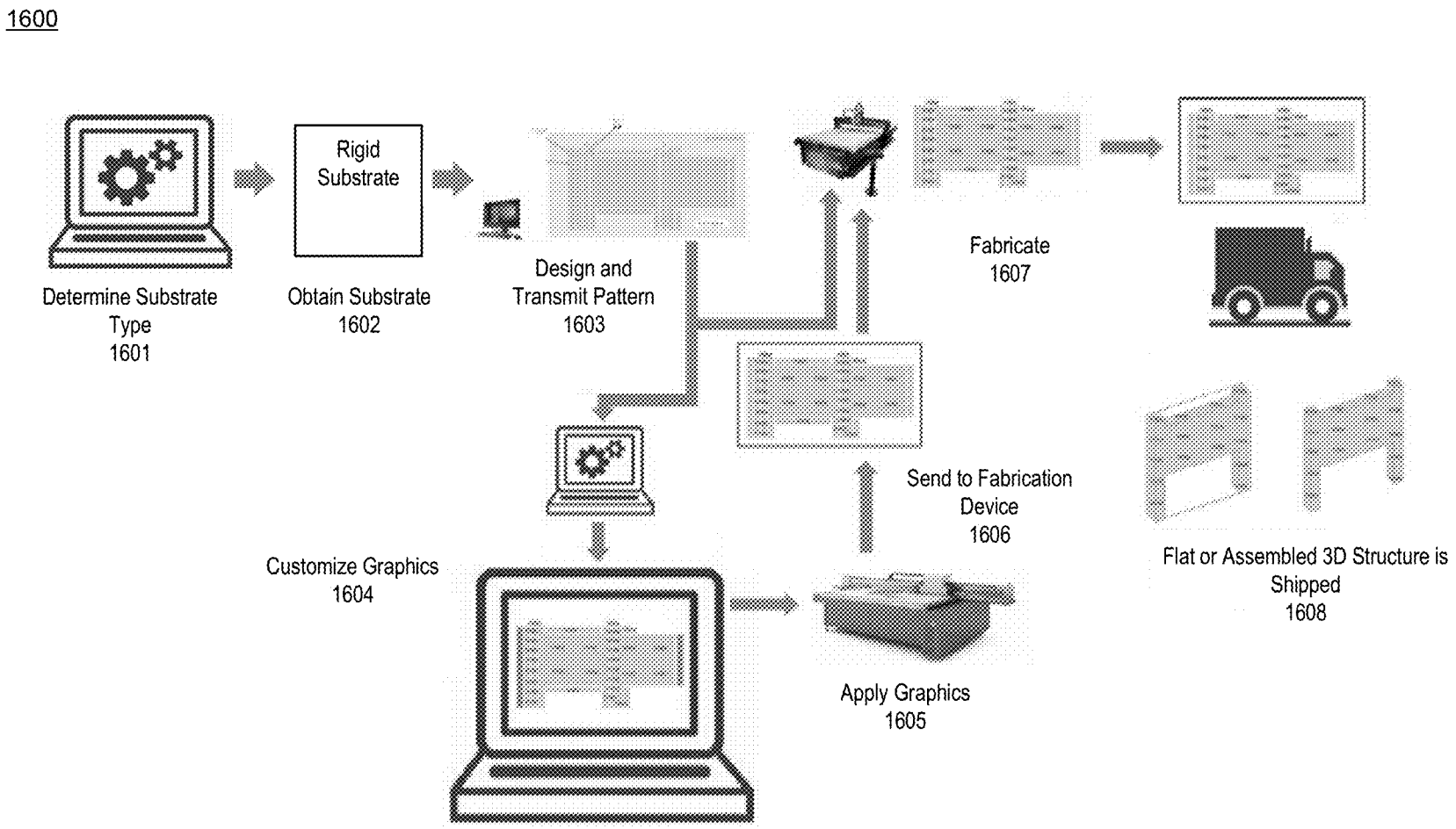

FIG. 33 depicts an illustrative flowchart 1600 for designing and fabricating a foldable structure. One or more of the steps of FIG. 33 may be performed by various devices described herein. The method may begin at step 1601 in which the designer 1206 may select materials for a foldable structure using designer device 1202. For instance, the designer 1206 may select materials for the foldable structure based on desired appearance, cost, durability, exterior lifespan, environment, rigidity, surface finish, dimensions, support structures, fasteners, fabrication restrictions, and/or material availability. At step 1602, a rigid substrate (e.g., blank) may be obtained. At step 1603, the designer 1206 may design a foldable structure using designer device 1202 and transmit the design to other devices. For instance, the designer 1206 may determine the 3D look of the finished foldable structure, size of the foldable structure, quantity of faces of the foldable structure, substrate quality, fold lines, joint types, fastening systems, and/or support structures (if any). The designer 1206 may also select a fabrication process, fabrication tooling, and/or fabrication speed. The designer 1206 may also create a parts list and graphical art. The designer device 1206 may transmit the device to fabrication device 1208 and/or to a remote computing device (e.g., a consumer's design device). At step 1604, a consumer may, using a designer device, customize the graphics for the foldable structure. At step 1605, the fabrication device 1208, another device (e.g., a printer), or an artist may apply the customized graphics to the substrate, which is then sent to the fabrication device 1208 at step 1606. At step 1607, the fabrication device 1208 may fabricate the foldable 3D structure. For instance, the fabrication device 1208 may receive the design from the designer device 1202. Based on the design, the fabrication device 1208 may cut the substrate to create edges, crush portions of the substrate to create fold lines, create fastening points, and affix fasteners to the fastening points. At step 1608, the foldable structure may be shipped to the consumer. The foldable structure may be shipped in either an assembled or unassembled configuration.

Computer System Architecture

Figure 34:
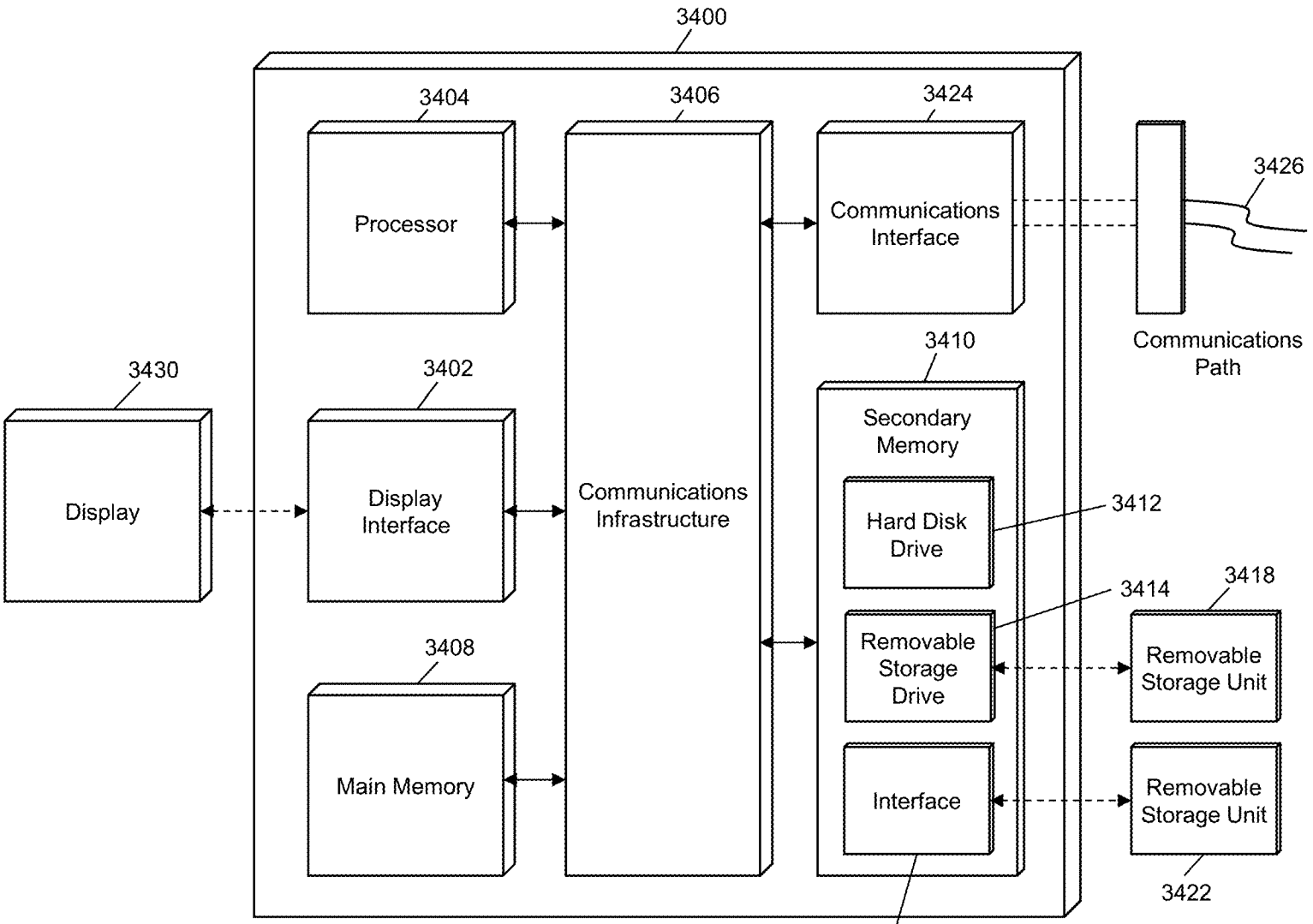
FIG. 34 illustrates an exemplary computer system.

FIG. 34 illustrates a computer system 3400 in which embodiments of the present disclosure, or portions thereof, may be implemented as computer-readable code. For example, one or more (e.g., each) of the designer device 1202, server 1204, and/or fabrication device 1208 may be implemented in the computer system 3400 using hardware, software, firmware, non-transitory computer readable media having instructions stored thereon, or a combination thereof and may be implemented in one or more computer systems or other processing systems. Hardware, software, or any combination thereof may embody modules and components used to implement the method of FIGS. 30-33.

If programmable logic is used, such logic may execute on a commercially available processing platform configured by executable software code to become a specific purpose computer or a special purpose device (e.g., programmable logic array, application-specific integrated circuit, etc.). A person having ordinary skill in the art may appreciate that embodiments of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device. For instance, at least one processor device and a memory may be used to implement the above described embodiments.

A processor unit or device as discussed herein may be a single processor, a plurality of processors, or combinations thereof. Processor devices may have one or more processor "cores." The terms "computer program medium," "non-transitory computer readable medium," and "computer usable medium" as discussed herein are used to generally refer to tangible media such as a removable storage unit 3418, a removable storage unit 3422, and a hard disk installed in hard disk drive 3412.

Various embodiments of the present disclosure are described in terms of this example computer system 3400. After reading this description, it will become apparent to a person skilled in the relevant art how to implement the present disclosure using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 3404 may be a special purpose or a general purpose processor device specifically configured to perform the functions discussed herein. The processor device 3404 may be connected to a communications infrastructure 3406, such as a bus, message queue, network, multi-core message-passing scheme, etc. The network may be any network suitable for performing the functions as disclosed herein and may include a local area network (LAN), a wide area network (WAN), a wireless network (e.g., WiFi), a mobile communication network, a satellite network, the Internet, fiber optic, coaxial cable, infrared, radio frequency (RF), or any combination thereof. Other suitable network types and configurations will be apparent to persons having skill in the relevant art. The computer system 3400 may also include a main memory 3408 (e.g., random access memory, read-only memory, etc.), and may also include a secondary memory 3410. The secondary memory 3410 may include the hard disk drive 3412 and a removable storage drive 3414, such as a floppy disk drive, a magnetic tape drive, an optical disk drive, a flash memory, etc.

The removable storage drive 3414 may read from and/or write to the removable storage unit 3418 in a well-known manner. The removable storage unit 3418 may include a removable storage media that may be read by and written to by the removable storage drive 3414. For example, if the removable storage drive 3414 is a floppy disk drive or universal serial bus port, the removable storage unit 3418 may be a floppy disk or portable flash drive, respectively. In one embodiment, the removable storage unit 3418 may be non-transitory computer readable recording media.

In some embodiments, the secondary memory 3410 may include alternative means for allowing computer programs or other instructions to be loaded into the computer system 3400, for example, the removable storage unit 3422 and an interface 3420. Examples of such means may include a program cartridge and cartridge interface (e.g., as found in video game systems), a removable memory chip (e.g., EEPROM, PROM, etc.) and associated socket, and other removable storage units 3422 and interfaces 3420 as will be apparent to persons having skill in the relevant art.

Data stored in the computer system 3400 (e.g., in the main memory 3408 and/or the secondary memory 3410) may be stored on any type of suitable computer readable media, such as optical storage (e.g., a compact disc, digital versatile disc, Blu-ray disc, etc.) or magnetic tape storage (e.g., a hard disk drive). The data may be configured in any type of suitable database configuration, such as a relational database, a structured query language (SQL) database, a distributed database, an object database, etc. Suitable configurations and storage types will be apparent to persons having skill in the relevant art.

The computer system 3400 may also include a communications interface 3424. The communications interface 3424 may be configured to allow software and data to be transferred between the computer system 3400 and external devices. Exemplary communications interfaces 3424 may include a modem, a network interface (e.g., an Ethernet card), a communications port, a PCMCIA slot and card, etc. Software and data transferred via the communications interface 3424 may be in the form of signals, which may be electronic, electromagnetic, optical, or other signals as will be apparent to persons having skill in the relevant art. The signals may travel via a communications path 3426, which may be configured to carry the signals and may be implemented using wire, cable, fiber optics, a phone line, a cellular phone link, a radio frequency link, etc.

The computer system 3400 may further include a display interface 3402. The display interface 3402 may be configured to allow data to be transferred between the computer system 3400 and external display 3430. Exemplary display interfaces 3402 may include high-definition multimedia interface (HDMI), digital visual interface (DVI), video graphics array (VGA), etc. The display 3430 may be any suitable type of display for displaying data transmitted via the display interface 3402 of the computer system 3400, including a cathode ray tube (CRT) display, liquid crystal display (LCD), light-emitting diode (LED) display, capacitive touch display, thin-film transistor (TFT) display, etc.

Computer program medium and computer usable medium may refer to memories, such as the main memory 3408 and secondary memory 3410, which may be memory semiconductors (e.g., DRAMs, etc.). These computer program products may be means for providing software to the computer system 3400. Computer programs (e.g., computer control logic) may be stored in the main memory 3408 and/or the secondary memory 3410. Computer programs may also be received via the communications interface 3424. Such computer programs, when executed, may enable computer system 3400 to implement the present methods as discussed herein. In particular, the computer programs, when executed, may enable processor device 3404 to implement the method of FIGS. 30-33. Accordingly, such computer programs may represent controllers of the computer system 3400. Where the present disclosure is implemented using software, the software may be stored in a computer program product and loaded into the computer system 3400 using the removable storage drive 3414, interface 3420, and hard disk drive 3412, or communications interface 3424.

The processor device 3404 may comprise one or more modules or engines configured to perform the functions of the computer system 3400. Each of the modules or engines may be implemented using hardware and, in some instances, may also utilize software, such as corresponding to program code and/or programs stored in the main memory 3408 or secondary memory 3410. In such instances, program code may be compiled by the processor device 3404 (e.g., by a compiling module or engine) prior to execution by the hardware of the computer system 3400. For example, the program code may be source code written in a programming language that is translated into a lower level language, such as assembly language or machine code, for execution by the processor device 3404 and/or any additional hardware components of the computer system 3400. The process of compiling may include the use of lexical analysis, preprocessing, parsing, semantic analysis, syntax-directed translation, code generation, code optimization, and any other techniques that may be suitable for translation of program code into a lower level language suitable for controlling the computer system 3400 to perform the functions disclosed herein. It will be apparent to persons having skill in the relevant art that such processes result in the computer system 3400 being a specially configured computer system 3400 uniquely programmed to perform the functions discussed above.

The detailed description above describes a system including one or more foldable blanks. The invention is not limited, however, to the precise embodiments and variations described. Various changes, modifications and equivalents can be effected by one skilled in the art without departing from the spirit and scope of the invention as defined in the accompanying claims. It is expressly intended that all such changes, modifications and equivalents which fall within the scope of the claims are embraced by the claims.

What is claimed is:

1. A foldable blank, comprising:

a flat sheet of material;

a plurality of fold lines formed into the flat sheet of material, wherein the flat sheet of material is foldable along the fold lines to configure at least one post, said at least one post defining an elongated interior, and a polygon-shaped display portion supported by and unitary with the at least one post, after the folding along the fold lines, the sheet of material being a single unitary piece both before and after the folding along the fold lines.

2. The foldable blank of claim 1, further comprising blank or solid color faces on the flat sheet of material.

3. The foldable blank of claim 1, further comprising color, graphics, text, and/or UV coatings digitally printed on the flat sheet of material.

4. The foldable blank of claim 1, wherein the unitary flat sheet of material further configures an openable box supported by the at least one post after the folding along the fold lines.

5. The foldable blank of claim 1, further comprising press through indicia bonded to the flat sheet of material.

6. The foldable blank of claim 1, wherein the elongated interior is configured to receive an elongated support.

* * * * *